US005101581A

United States Patent [19]

Hilgarth

[11] Patent Number: 5,101,581

[45] Date of Patent: Apr. 7, 1992

[54] DAMPING ELEMENT FOR SKI BOOTS

[75] Inventor: Kurt Hilgarth, Graz, Austria

[73] Assignee: Dynafit Skischuh Gesellschaft m.b.H., Graz, Austria

[21] Appl. No.: 627,958

[22] Filed: Dec. 17, 1990

[30] Foreign Application Priority Data

Dec. 18, 1989 [AT] Austria ..... 2867/89

[51] Int. Cl.[5] ..... A43B 5/04; A43B 5/16

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 3,633,291 | 1/1972 | Caporicci | 36/121 |
| 4,519,149 | 5/1985 | Pozzobon | 36/121 |
| 4,962,595 | 10/1990 | Perner | 36/117 |
| 4,991,319 | 2/1991 | Perner | 36/117 |

FOREIGN PATENT DOCUMENTS

| | | | |
|---|---|---|---|
| 0358633 | 3/1990 | European Pat. Off. | 36/117 |
| 2057094 | 5/1973 | Fed. Rep. of Germany | 36/121 |
| 2341283 | 10/1977 | France | 36/121 |
| 2498432 | 7/1982 | France | 36/121 |
| 2547487 | 12/1984 | France | 36/119 |
| 2608903 | 7/1988 | France | 36/117 |

*Primary Examiner*—Paul T. Sewell
*Assistant Examiner*—Marie D. Patterson
*Attorney, Agent, or Firm*—Fleit, Jacobson, Cohn, Price, Holman & Stern

[57] ABSTRACT

Damping element for ski boots, comprising a collar 21, swivellable in skiing direction, in relation to a shell 20, the swivel movement being damped in forward direction by a damping spring 9, positioned on the heel side, which is supported on a shoulder 22 of the collar 21 on the one hand, and on a bolt 3, mounted in the shell 20, on the other, the bolt in the shell 20 being mounted level- adjustably and lockably.

10 Claims, 2 Drawing Sheets

DAMPING ELEMENT FOR SKI BOOTS

BACKGROUND OF THE INVENTION AND PRIOR ART

The invention relates to a damping element for ski boots, comprising a collar, swivellable in the skiing direction, in relation to a shell, the swivel movement being damped in forward direction by a damping spring, positioned on the heel side, which is supported on a shoulder of the collar on the one hand and on a bolt, mounted in the shell, on the other.

Known damping elements of this kind suffer from the disadvantage that they exert strain on the collar in the sense of a lateral bulging, whereby the support of the leg in the collar is impaired.

OBJECTS OF THE INVENTION

It is the object of the invention to provide expedients which eliminate these disadvantages, to provide adjustability for the damping spring, to avoid strain on and lateral bulging of the collar and improved support of the leg in the collar.

GENERAL DESCRIPTION OF THE INVENTION

In order to attain these objects, it is proposed, according to the invention, that the bolt, loaded by the damping spring, is mounted in the shell level-adjustably and lockably.

In an advantageous manner, the bolt, loaded by the damping spring, is fixed at its shell side end by means of a ball and socket joint in a sleeve, pivotally to a limited extent in the skiing direction, the sleeve being level-adjustable.

According to a further feature of the invention, the sleeve is provided with at least two catch formations, axially spaced apart and angularly staggered relative to each other, into which a counter catch member, activatable from outside, engages selectively.

According to a further feature of the invention, the catch formations are formed as apertures, which are spaced in relation to each other in respect of levels and angles, the counter catch member being designed as a spring loaded locking bolt, hinged to an operating lever, which, due to the load exercised by the spring, is pressed into the apertures by way of a locking pin.

For the purpose of providing the possibility of enabling the foot to bend easily in the ski boot during walking and in order to every time attain the same preset catch formation for the setting of the downhill position, a groove is provided on the outer surface in the axial direction of the sleeve, successive to each of the apertures, serving as catch formations, into which a projection of the locking pin serving as counter catch member, engages, if the locking pin is pulled out of the catch formation.

In an advantageous manner the locking pin is accommodated in a sleeve, which is pushed onto the sleeve for the support of the pin, loaded by the damping spring, transversely to the sleeve. Finally, it is an aspect of the invention for the locking pin to be provided with a collar guided in the transverse sleeve, on the outer side of which the pin, engaging into the catch formation is provided.

BRIEF DESCRIPTION OF THE DRAWING

Further features of the invention are explained in more detail with reference to the drawing, in which a working example of the damping element according to the invention is illustrated. There are shown in FIG. 1 an axial longitudinal section of a damping element, installed in the ski boot, along the line I—I of FIG. 2 and in FIG. 2 a section along the line II—II of FIG. 1.

DESCRIPTION OF SPECIFIC EMBODIMENT

Figure 1:
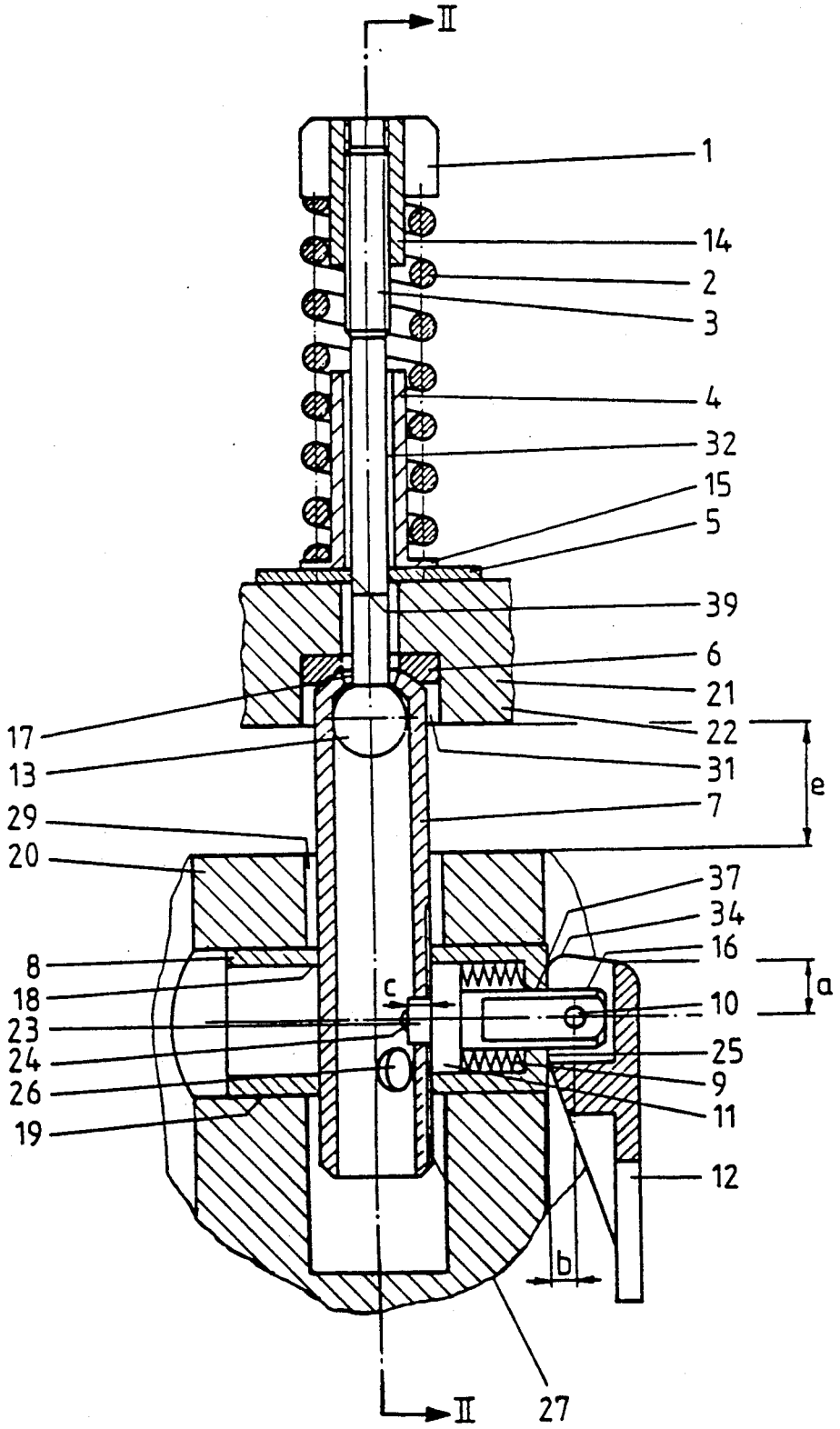
Figure 2:
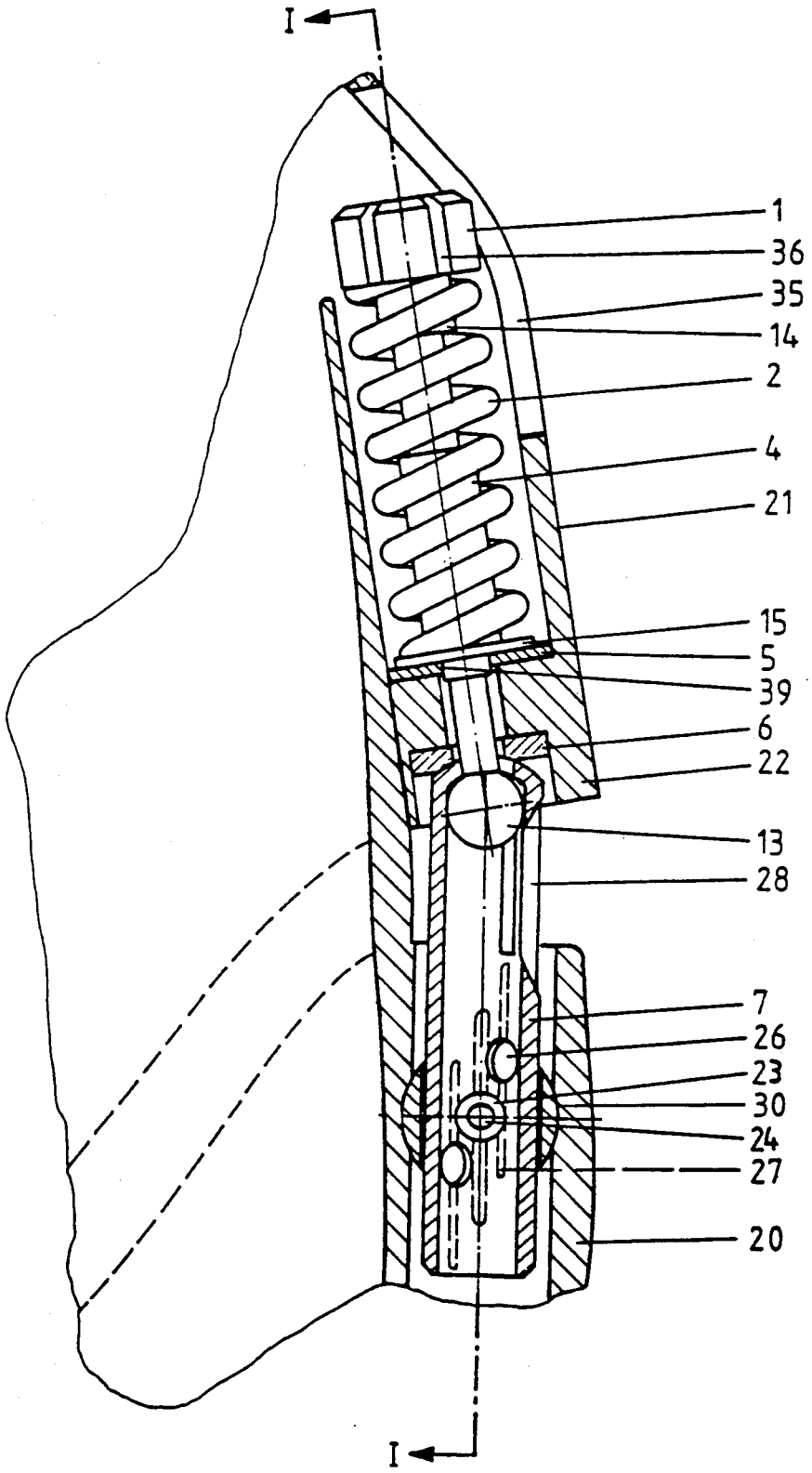

A threaded bolt 3, embraced by a coil spring 2, is embedded in a heel side recess of a ski boot, consisting of an undershell 20 and a collar 21, the threaded bolt carrying a ball 13 at its lower end, which is held in the upper end of a sleeve 7, being pivotally mounted and adjustable in height in a shell 20. The threaded bolt 3 passes through the bottom of the sleeve 7 in a bore 17, which allows a tolerance for the bolt 3 for a limited pivot movement in the walking direction of the ski boot. The coil spring, on the one hand, is supported on a nut 1 screwed onto the upper end of the threaded bolt 3, which is provided with a sleeve 14 engaging into the coil spring 2. On its other end, its lower end respectively, the coil spring 2 is supported on a laterally protruding shoulder 15 of a sleeve 4, which engages into the lower end of the coil spring and forms a shoulder for the sleeve 14. The sleeve 4 with its lower shoulder 15 rests on a plate 5, which rests on a shoulder 22 of the collar 21.

The sleeve 7 is mounted in a cross-bore 18 of a sleeve 8, which is in turn embedded in a recess 19 of the shell 20, and carries a locking bolt 16, which is guided in the sleeve 8 by way of a collar 11 and which is hinged to an operating lever 12 at its end projecting from the sleeve 8 by means of a linkage pin 10. On its end facing the sleeve 7, the collar 11 is provided with a locking pin 24, which engages into a catch hole 26 of the sleeve 7 under the bias of a spring 9. The sleeve 7 comprises a plurality of catch holes 26, three in the present case, which are staggered in different positions of height, and angular displacement towards each other. Successively to the catch holes, grooves 27 are provided extending concentrically upwards and downwards, forming recesses on the outside of the sleeve 7. The spring 9 is supported on the collar 11 on the one hand and on the bottom 25 of the sleeve 8 on the other, in which a bore 37 is provided for the passage of the locking bolt 16. In order to pull out the locking pin 23 from the catch hole during swivelling of the lever 12 into the horizontal position, without the projection 24 leaving the groove 27, the locking lever 12 is so designed that the adjusting path of the locking bolt 16 during swivelling of the locking lever 12 from the locked position to the unlocked position equals the depth, to which the locking pin 23 engages into the catch hole 26. During swivelling of the locking lever 12 into a certain intermediate position, in the present case into a position, in which the locking lever with its corner 34 finds support on the sleeve 8, the distance of travel of the locking bolt 16 should in this context exceed by the length of the projection 24 the path of travel during swivelling of the locking lever 12 from the locking position into the opening position. For that purpose the distance —a— between the pivot pin 10 and the upper face of the lever 12 may be so dimensioned that the distance —a— minus distance —b— between the pivot pin 10 and the bottom 25 of the sleeve 8, on which the lever is supported, equals the depth —c—, by which the locking pin 23 enters into the catch hole 26. For the purpose of twisting the sleeve 7, the projection 24 must withdraw from the groove 27, as will be described in more detail further below. For that purpose the distance of the corner 34 of the lever 12 from the pivot pin 10 is greater than the distance —a—, namely by at least the length of the projection 24.

Naturally, other measures may also be taken to ensure that in a locking position of the locking lever 12, as illustrated in FIG. 1, the locking pin 23 engages into the catch hole 26, when the collar 11 is supported preferably on the sleeve 7, and where during swivelling of the locking lever into an open position, for example into a horizontal position, the locking pin 23 withdraws from the catch hole 26, without, however, moving the projection 24 from the engagement with the groove 27. Only when the locking lever 16 is brought into an intermediate position between the opening position and the locking position, should the projection 24 withdraw from the engagement with the groove 27, so that the sleeve 7 may be turned.

In order to adjust the angle of the sleeve 7, longitudinal slots 28 are provided at the upper end of the latter, the number of which corresponds preferably to the number of catch holes 26 and which are advantageously positioned towards each other at distances equal to those of the catch holes.

The sleeve 7 is supported at its upper end on a washer 6, at the bottom of a recess 31 of the collar 21, providing a rounded seat so that a slight angular displacement between the washer 6 and the sleeve 7 is possible during swivelling of the collar 21 in the skiing direction, thus avoiding bending stress on the threaded bolt 3. If such bending stress is acceptable, it is possible to design the threaded bolt 3 and the sleeve 7 in one piece.

The sleeve 7 is accommodated with a tolerance in a vertical bore 29 of the shell 20 and pivotally mounted in the bore 18 of the sleeve 8, fitted in a transverse bore 30 of the shell 20. The threaded bolt 3 is provided with a flat region, fitting a matching opening 39 of the washer 5, thus securing the threaded bolt 3 against turning. An adjustment of the nut 1 may be performed by means of a screwdriver, a coin or the like, which is/are insertable into slots 36 of the nut 1 through a window 35 in the wall of the collar 21. The window 35 is covered by a cover, not shown, preferably adapted to open upwardly.

The damping element according to the invention operates as follows: In the illustrated position of the damping element the locking pin 23 engages into the middle catch hole 26, so that a centrically inclined forward position is adjusted for skiing. If the skier wants to walk comfortably with the ski boot, he swivels the lever 12 into its horizontal position, thus releasing the locking pin 23 from the catch hole 26, so that the collar may swivel freely around its swivel axis and thus takes along the sleeve 7. During this movement of the sleeve 7, the projection 24 engages into the groove 27, whereby the movement of the collar in forward direction is restricted by the length of the groove 27 in upward direction, while the swivel movement in the other direction is restricted by the length of the groove downwardly or by the distance —e— of the collar 21 of the shell 20. Should the skier wish to engage into the original position, he swivels the lever 12 back into the position as shown and moves the foot until the locking pin 23 engages again into the mean catch hole 26 due to the bias of the spring 9. The guidance of the projection 24 in the groove 27 prevents an inadvertent twisting of the sleeve 7. Should the skier wish to adjust for a greater or lesser forward leaning position, he turns the sleeve 7 with a coin or a screwdriver-like tool, which he inserts into the slot 27 opposite him, in the one or other direction, so that the locking pin 23 during axial movement of the sleeve 7 comes to rest in the track of the catch hole 26, positioned higher or lower, as the case may be. Before twisting the sleeve 7, the lever 12 is adjusted into an inclined intermediate position, in which the corner 34 is supported on the bottom of the sleeve 8, causing the projection 24 to withdraw from the groove 27. For that purpose the distance of this corner from the pivot pin 10 exceeds the distance —a— at least by the length of the projection 24.

If the damping element is to be blocked, the nut 1 is screwed onto the thread of the threaded bolt 3 by such a distance that the sleeve 14 abuts on the sleeve 4.

I claim:

1. Damping element for ski boots, comprising a collar, swivellable in skiing direction in relation to a shell, the swivel movement being damped in forward direction by a damping spring, positioned on a heel side of the boot and which is supported at one end on a shoulder of the collar and at a distal end on a bolt mounted with one end projecting through the shoulder, said end of the bolt is connected to a cylindrical sleeve axially adjustable relative to the shell, the sleeve having at least two catch formations each at a specific angular position about the sleeve and spaced axially apart along the sleeve to define adjustment levels, a counter-catch, activated and deactivated from outside the shell, engages with a selected catch formation to lock the sleeve in a selected adjustment level, at least one groove extends in the axial direction along the surface of the sleeve, and projection means engage into the groove when the counter-catch member is deactivated to allow limited axial motion of the sleeve for free swivelling in the skiing direction for walking and to prevent rotation of the cylindrical sleeve to maintain the selected catch formation in correct angular alignment with the counter-catch member for immediately, easily achieving the selected adjustment level upon reactivating the counter-catch.

2. Damping element according to claim 1, wherein the bolt (3), loaded by the damping spring (2), is connected by a ball and socket joint (13) to the sleeve (7), for pivoting to a limited extent in the skiing direction.

3. Damping element according to claim 1, wherein the catch formations are positioned angularly staggered bout the sleeve relative to each other and wherein the sleeve is rotated to select a level and the collar is swivelled and counter-catch activated to engage the catch formation to lock the sleeve in the selected level.

4. Damping element according to claim 1, wherein the catch formations include apertures (26), and the counter catch member includes a spring loaded locking bolt (16) hinged at an exterior end to a locking lever (12) outside of the shell and having at an interior end a locking pin (23) which is pressed into the apertures (26) by a bias applied by a locking spring (9) when the locking lever is activated.

5. Damping element according to claim 3, wherein, for each of the catch formations, a corresponding said groove (27) is provided at angularly staggered positions related to the angular positions of said catch formations and said projection means engage into the groove related to the selected catch formation, when the counter-catch member is deactivated wherein, once set, any selected adjustment level can be immediately achieved by reactivating the counter catch and swivelling the collar.

6. Damping element according to claim 4, wherein the locking bolt (16) is accommodated in a locking sleeve (8), which is pushed onto and transversely to the sleeve (7) for the support of the bolt (3), loaded by the damping spring (9).

7. Damping element according to claim 4, wherein the locking bolt (16) comprises, guided in the transverse sleeve (8), a collar (11), on the outside of which the pin (23) is provided, engaging into the catch formation.

8. Damping element according to claim 4, wherein the adjusting path distance of the locking bolt (16) during swivelling of the locking lever (12) from the locked position to the unlocked position equals the depth (c), to which the locking pin (23) engages into the catch hole (26).

9. Damping element according to claim 8, wherein during swivelling of the locking lever (12) into an intermediate position, the distance of travel of the locking bolt (16) exceeds the path of travel during swivelling of the locking lever (12) from the locking position into the opening position, by the length of the projection (24).

10. Ski boot comprising a damping element as claimed in claim 1.

* * * * *